United States Patent [19]

Frewer et al.

[11] 4,300,916

[45] Nov. 17, 1981

[54] METHOD AND APPARATUS FOR THE GASIFICATION OF COAL

[75] Inventors: Hans Frewer, Marloffstein; Rainer Müller; Ulrich Schiffers, both of Erlangen, all of Fed. Rep. of Germany

[73] Assignee: Kraftwerk Union Aktiengesellschaft, Mülheim, Fed. Rep. of Germany

[21] Appl. No.: 125,526

[22] Filed: Feb. 28, 1980

[30] Foreign Application Priority Data

Mar. 6, 1979 [DE] Fed. Rep. of Germany ..... 2908772

[51] Int. Cl.[3] ..... C10J 3/46; C10J 3/00

[52] U.S. Cl. ..... 48/210; 48/73; 48/77; 48/202

[58] Field of Search ..... 48/77, 73, 202, 210; 201/22-24, 5, 8; 208/8; 44/10 C, 10 H, 10 K

[56] References Cited

U.S. PATENT DOCUMENTS

| | | | |
|---|---|---|---|
| 3,692,505 | 9/1972 | Reichl | 48/202 X |
| 3,920,418 | 11/1975 | Rice | 48/210 |
| 4,095,959 | 6/1978 | Künstle et al. | 48/73 |

*Primary Examiner*—Michael S. Marcus

*Attorney, Agent, or Firm*—Herbert L. Lerner; Laurence A. Greenberg

[57] ABSTRACT

Gasification of coal by hydrogenation to produce $CH_4$ hydrocarbons, and by steam to produce hydrogen. Forming a medium-grain and a small-grain fractions from coal. Hydrogenating the volatile and readily reactive components of part of the small-grain fraction to form hydrocarbons and coke. Mixing the coke with the other part of the small-grain fraction. Forming briquets from the mixture. Mixing the briquets with medium size coal fraction and steam gasifying to produce hydrogen. The hydrogentation is preferably carried out in a fluidized bed operation and the steam gasification in a fixed-bed operation.

6 Claims, 1 Drawing Figure

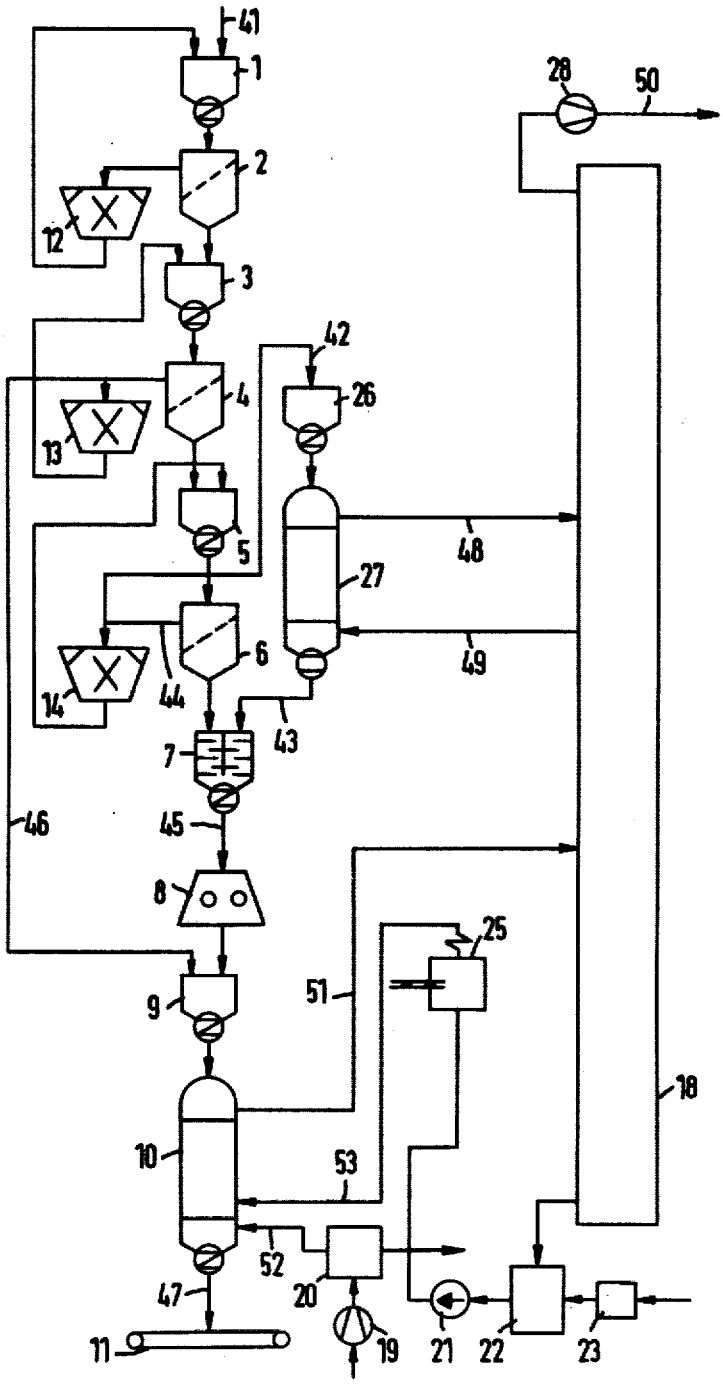
41
1
2
12
3
42
4
26
13
5
48
27
6
49
14
44
43
7
46
45
8
25
51
9
18
10
53
52
47
20
11
19
21
22
23
28
50

METHOD AND APPARATUS FOR THE GASIFICATION OF COAL

BACKGROUND OF THE INVENTION

1. Field of the Invention

The invention relates to the gasification of coal, in which the volatile and readily reactive components of the coal are converted through the addition of hydrogen ($H_2$) into hydrocarbon-containing gas ($CH_4$, $C_2H_6$), and a steam gasifier connected thereto and fed with steam, for generating a hydrogen-rich gas.

2. Description of the Prior Art

Gasification of coal with added hydrogen in a hydrogenation gasifier and with added steam in a steam gasifier is known. In German Patent No. 26 09 320, for instance, coal gasification apparatus is described, in which the coal is partially gasified in a hydrogenation gasifier with the addition of hydrogen and in which a hydrogenation gasifier is followed by a steam gasifier. The steam gasifier obtains its steam from a nuclear reactor or steam generator which employs energy derived from fossil fuel and generates hydrogen-containing gas which is suitable for use in the preceding hydrogenation gasifier.

SUMMARY OF THE INVENTION

An object of the present invention is to provide a method for the gasification of coal which will ensure that a sufficient quantity of hydrogen is generated in the steam gasifier to carry out the hydrogenation gasification as completely as possible. Coal with high ash content and low carbon content or coal with low carbon value may also be used. Another object of the invention is to provide a method for gasification in which the expense for comminuting the coal is low. A further object of the invention is to provide a method in which fine-grain coal is provided for the hydrogenation gasification preferably in a fluidized bed, and medium-grain coal for the steam gasification which takes place advantageously in a fixed bed.

With the foregoing and other objects in view, there is provided in accordance with the invention a method for the gasification of coal to convert volatile and readily reactive components in coal into hydrocarbons composed principally of $CH_4$ with lesser amounts of $C_2H_6$ and other hydrocarbons by the addition of hydrogen, and generating a hydrogen-containing gas by the addition of steam, comprising forming from the coal at least two fractions, a medium-grain fraction of larger grain size and a small-grain fraction of smaller grain size, subjecting a portion of the small-grain fraction of the coal to hydrogenation in a hydrogenation zone in the presence of added hydrogen at an elevated temperature to produce gaseous constituents containing hydrocarbons and a non-vaporous residual coke component containing principally carbon and ash, releasing the gaseous constituents from the hydrogenation zone, discharging the hot residual coke component from the hydrogenation zone, mixing the hot residual coke with another portion of said small-grain fraction of the coal, pressing said mixture to produce briquets, subjecting said briquets together with a medium-grain fraction of coal to steam gasification in a steam gasification zone in the presence of added steam at an elevated temperature to generate a hydrogen-containing gas leaving as residue an ash containing principally non-combustible material, releasing the hydrogen-containing gas from the gasification zone, and discharging the ash from the gasification zone.

Other features which are considered as characteristic for the invention are set forth in the appended claims.

Although the invention is illustrated and described herein as embodied in a method and apparatus for the gasification of coal, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawings in which is diagrammatically illustrated method and apparatus for carrying out the present invention. In the drawing is shown the combination of sieves, mills and collecting tanks to separate the coal into fractions of different grain size, a hydrogenation gasifier to convert volatile components of the coal to hydrocarbons, a mixer for mixing the hot coke with fine-grain coal, a briquetting press for forming briquets from the mixture, and a steam gasifier for gasification of the briquets together with medium-grain coal.

DETAILED DESCRIPTION OF THE INVENTION

In accordance with the invention, the coal is divided into fractions of different grain size. Fine-grain coal is fed in part to the hydrogenation gasifier and in part to a mixing vessel following the hydrogenation gasifier for mixing with the residual coke from the hydrogenation gasification. The mixture from the mixing vessel is transported into a briquetting press. The briquets made in the briquetting press are fed, together with medium-grain coal, to the steam gasifier.

An embodiment example is shown schematically in the drawing. The accompanying Table shows the compositions of the various streams of matter passing through the installation shown in the drawing. The columns of the Table are marked with reference symbols 41–53 and like reference symbols are shown in the drawing. To illustrate, raw hard coal given a reference symbol 41, is shown entering collecting tank 1 of the drawing. The Table has a column marked 41, which column shows the composition of the raw hard coal. Referring to the drawing, coal with an ultimate analysis as shown in column 41 of the Table is fed into a collecting tank 1 for coarse-grain coal. The collecting tank may be any suitable vertical tank with an inclined bottom to facilitate flow of coal into a central bottom opening equipped with known valve arrangement to regulate discharge of coal from the tank. A sieve 2 is connected to tank 1 receiving the coal therefrom, and separating the coarse grain from the medium-size grain. The coarse grain fraction of coal is directed into a mill 12, from which it is returned, after coarse comminution, to the collecting tank 1.

The medium-size grain leaving the sieve 2 flows into collecting tank 3 similar to collecting tank 1, and from there to another sieve 4 wherein the medium-size grain fraction of coal is separated from the small-grain fraction of coal. The medium-size grain with a composition according to column 46 of the Table is transported to a mixing vessel 9. The larger pieces are comminuted in mill 13 and returned to the collecting tank 3.

The small-grain fraction of coal leaving the sieve 4 is fed to a collecting tank 5, and there passes to sieve 6. Part of coarser components of the fine-grain coal are comminuted in mill 14 and then returned to the collecting tank 5. Part of the coarser components of the fine-grain coal are fed to a metering tank 26. The composition of the coarser components of the fine-grain coal corresponds to column 42 of the Table. The metering tank 26 is followed by a hydrogenation gasifier 27, which is supplied with hydrogen-rich hydrogenation gas according to column 39 of the Table from a plant 18 for gas processing and heat recovery. The hydrogenation gasification process takes place in the vessel 27 in which the volatile and readily reactive components of the coal, together with part of the hydrogen from the hydrogenation gas are converted into hydrocarbons.

The residual coke drawn-off at the bottom of the hydrogenation gasifier 27 is fed to a mixing vessel 7, into which the small-grain raw coal leaving the sieve 6 having a composition according to column 44 of the Table is also fed.

The hot residual coke with a composition according to column 43 of the Table is now mixed in the mixing vessel 7 with the coal powder, so that the latter is heated up by the hot coke in the mixing process. The mixing ratio can be adjusted so that a temperature in the softening range of the coal will be reached at the exit of the mixing vessel 7. The composition of this coal mixture corresponds to column 45 of the Table. This mixture arrives at a briquetting press 8 where it is pressed into briquets under pressure. In this process, the baked-together components of the coal fraction taken from the sieve 6 act as binder for the residual coke from the hydrogenation gasifier.

The briquets produced in the briquetting press 8 together with the medium-grain fraction from sieve 4 are mixed in mixing vessel 9. If desired, a different type, kind or grade of coal may be fed into vessel 9.

The mixing vessel 9 also acts as a metering tank for the flow of briquets and medium size fraction of coal into the following steam gasifier 10. Steam composition given in column 53 of the Table is fed into the steam gasifier 10. This steam is taken from a steam generator operated with fossil fuel or nuclear heat. The feed water provided for the steam generator 25 gets into the steam generator 25 from water supply tank 22 by means of feed pump 21. Water from an external source is treated in feed water treating plant 23 and the treated water sent to water supply tank 22. Water separated in purification plant 18 is reused by passing it into supply tank 22.

In addition, oxygen as shown in column 52 of the Table is introduced into the steam gasifier 10. This oxygen is obtained from an air separation plant 20 which is supplied with air by an air compressor 19. The nitrogen separated in plant 20 is discharged into the atmosphere. The oxygen serves for generating, by partial combustion of the coal, the remaining requirement for endothermic reaction heat for the steam gasification. The ash product, composition in column 47 of the Table, is drawn off from the steam gasifier 10 and removed by conveyor device 11.

The hydrocarbon-rich synthetic natural gas (SNG with composition according to column 50 of the Table), separated from the other components in plant 18, is drawn off by means of a gas compressor 28 and fed into a gas supply line. Water from plant 18 is returned via tank 22 and then by means of pump 21 directed to steam generator 25. While other products obtainable from the plant 18 for gas purification and heat recovery are also present, their use is not mentioned here.

The various equipment employed in the operation, such as collecting tanks, mills, mixers, briquetting press, hydrogenation gasifier, steam gasifier, air separation plant, steam generator and gas purification plant are known. These are connected, as shown in the drawing and described herein, with suitable piping and instrumentation in accordance with good construction practice. In a preferred method of operation, hydrogenation gasification is conducted as a fluidized-bed operation in which operation as is known the particles of coal are small-grain, i.e. sufficiently small to be fluidized in a bed by hydrogen gases passing upwardly through the bed. The hydrogenation reaction is carried out at an elevated temperature, usually above 700° C. up to about 900° C. or more. The steam gasification is desirably conducted as a fixed-bed operation in which operation the particles subjected to gasification are sufficiently large to remain static in a bed while steam is passed in contact with it. There may be some variation of the size of the particles depending to some extent on the linear velocity of the gas or steam and the density of the particles, but this presents no difficulty because fluidized-bed and fixed-bed operations are well known. Merely as illustration, a small-grain fraction of coal for a fluidized-bed operation is a coal fraction which passes through a No. 18 sieve U.S. Sieve Series. A medium-grain fraction of coal for a fixed-bed operation is a coal fraction which passes through a 1.5 inch sieve, U.S. Sieve Series and remains on a 5/16 inch sieve. The steam gasification is carried out at an elevated temperature, usually above 500° C. up to about 700° C. or more.

By means of the described method and the described apparatus, a sufficient quantity of hydrogen can also be made available for grades of coal rich in ash as well as for coals with different qualities and grain sizes. This applies to the use of lignite for the hydrogenation gasification, since in the hydrogenation gasification of the lignite, a larger share of the lignite can be gasified than through hydrogenation gasification of hard coal. Also for hard coal of different reactivity, it is advantageous to feed the more reactive grade of hard coal predominantly into the hydrogenation gasifier 27. On the other hand, it is also possible to obtain, by adjusting appropriate mixing ratios between the residual coke and raw coal, an excess of CO- and $H_2$-containing gas which can serve for other uses, for instance, the reduction of metal ores, for the production of fuel, fertilizer etc.

In some coal mines, coal is found which has a large and heavily varying content of ash and other ballast matter such as rock and mineral matter. This coal, before it is used further, is customarily subjected to a separating process which separates the coal into fractions of different composition, utilizing different material density, different adhesion properties of the surface or other chemical or physical properties. It is particularly advantageous here to control the processing in such a manner that in the average, the fractions with higher coal content and more reactivity are produced with smaller grain size. These fractions are then preferably fed to the hydrogenation gasifier 27, and a high effectiveness of the hydrogenation gasification is achieved thereby with small throughput.

TABLE

| | 41 Raw hard coal kg/second | 42 Hard coal Small grain fraction kg/second | 43 Residual coke kg/second |
|---|---|---|---|
| C | 105.9 | 65.8 | 29.5 |
| H | 6.2 | 3.8 | 0.4 |
| O | 8.7 | 5.4 | 0.05 |
| N | 1.9 | 1.2 | 0.1 |
| S | 1.2 | 0.7 | 0.3 |
| Ash | 14.8 | 9.2 | 9.2 |
| $H_2O$ | 8.8 | 5.5 | — |
| | 147.5 | 91.6 | 39.55 |

| | 44 Hard coal fines fraction kg/second | 45 Hard coal charge briquetting kg/second | 46 Hard coal medium-gr. fraction kg/second | 47 Ash kg/second |
|---|---|---|---|---|
| C | 14.4 | 43.9 | 25.7 | 3.5 |
| H | 0.8 | 1.2 | 1.5 | — |
| O | 1.2 | 1.25 | 2.1 | — |
| N | 0.3 | 0.4 | 0.5 | — |
| S | 0.2 | 0.5 | 0.3 | — |
| Ash | 2.0 | 11.2 | 3.6 | 14.8 |
| $H_2O$ | 1.2 | 1.2 | 2.15 | — |
| | 20.1 | 59.65 | 35.85 | 18.3 |

| | 48 Raw Gas Hydrogenation gasification | | 49 Hydrogenation gas | |
|---|---|---|---|---|
| | $m^3$/second | Mol-% | $m^3$/second | Mol-% |
| $CO_2$ | 0.3 | 0.1 | 1.3 | 0.5 |
| CO | 11.2 | 4.6 | 8.6 | 3.1 |
| $H_2$ | 155.1 | 63.1 | 255.4 | 90.8 |
| $CH_4$ | 70.0 | 28.4 | 9.7 | 3.4 |
| $C_2H_6$ | 2.5 | 1.0 | 0.6 | 0.2 |
| $N_2$ | 6.6 | 2.7 | 5.7 | 2.0 |
| $H_2S$ | 0.3 | 0.1 | — | — |
| | 246.0 | | 281.3 | |
| P[bar] | 78 | | 80 | |
| T[°C.] | 900 | | 700 | |

| | 50 Natural Synthesis Gas | | 51 Raw gas Steam gasification | |
|---|---|---|---|---|
| | $m^3$/second | Mol-% | $m^3$/second | Mol-% |
| $CO_2$ | — | — | 37.4 | 16.8 |
| CO | 0.1 | 0.1 | 70.5 | 31.8 |
| $H_2$ | — | — | 103.2 | 46.2 |
| $CH_4$ | 68.4 | 96.4 | 8.2 | 3.7 |
| $C_2H_6$ | 2.5 | 3.5 | 0.6 | 0.3 |
| $N_2$ | — | — | 1.9 | 0.8 |
| $H_2S$ | — | — | 0.5 | 0.2 |
| | 71.0 | | 222.3 | |
| P[bar] | 70 | | 10 | |
| T[°C.] | 30 | | 600 | |

52 Oxygen for Steam Gasification: 24.0 $m^3$/s (5% $N_2$, 95% $O_2$)
53 $H_2O$ Steam for Steam Gasification: (143 kg/s (30 bar, 400° C.)

There are claimed:

1. Method for the gasification of coal to convert volatile and readily reactive components in coal into hydrocarbons composed principally of $CH_4$ with lesser amounts of $C_2H_6$ and other hydrocarbons by the addition of hydrogen, and generating a hydrogen-containing gas by the addition of steam, comprising forming from the coal two grain fractions, a coarse fraction and a fine fraction, subjecting a portion of the fine fraction of the coal to hydrogenation in a hydrogenation zone in the presence of added hydrogen at an elevated temperature about 700° C. to produce principally gaseous constituents containing hydrocarbons and a non-vaporous residual coke component containing principally carbon and ash, releasing the gaseous constituents from the hydrogenation zone, discharging the hot residual coke component from the hydrogenation zone, mixing the hot residual coke with another portion of said fine fraction of the coal, pressing said mixture to produce briquets, subjecting said briquets together with a coarse fraction of coal to steam gasification in a steam gasification zone in the presence of added steam at an elevated temperature to generate a hydrogen-containing gas leaving as residue an ash containing principally non-combustible material, releasing the hydrogen-containing gas from the gasification zone, and discharging the ash from the gasification zone.

2. Method according to claim 1, wherein at least part of said fine coal grain fraction of the coal is passed into a sieve to separate said fine fraction into a further coarse fraction and a further fine fraction, and said further fine fraction separated by the sieve forms the part of the coal which is mixed with said hot residual coke.

3. Method according to claim 1, wherein said fine fraction of the coal is maintained as a fluidized-bed when subjected to gasification by hydrogenation and wherein said briquets together with the said coarse fraction are maintained as a fixed-bed when subjected to gasification by the addition of steam.

4. Method according to claim 1 or claim 2 or claim 3, wherein the coal is a high-ballast coal which is separated in a processing operation according to specific material density, surface properties or other chemical or physical material properties, into different fractions having higher and lower coal content and reactivity and wherein the fractions with higher coal content and reactivity are fed to the hydrogenation zone.

5. Method according to claim 1, wherein coal fed into said hydrogenation zone is more reactive than the coal fed into said steam gasification zone.

6. Method according to claim 5, wherein said coal fed into said hydrogenation zone is lignite.

* * * * *